United States Patent [19]

Soublière

[11] Patent Number: 4,939,861

[45] Date of Patent: Jul. 10, 1990

[54] SHELF TAG MOULDING ATTACHMENT ASSEMBLY

[75] Inventor: Marc P. Soublière, Mississauga, Canada

[73] Assignee: Telepanel, Inc., Ontario, Canada

[21] Appl. No.: 138,585

[22] Filed: Dec. 28, 1987

[51] Int. Cl.[5] ..... G09F 3/20

[52] U.S. Cl. ..... 40/651; 248/222.3; 248/231.3; 248/216.1

[58] Field of Search ..... 40/651, 652, 650; 248/222.1, 222.3, 231.3, 316.5, 222.2, 225.1, 216.1

[56] References Cited

U.S. PATENT DOCUMENTS

| | | | |
|---|---|---|---|
| 222,086 | 11/1879 | Slemmer | 248/231.3 |
| 2,197,657 | 4/1940 | Churchill | 40/652 |
| 3,034,756 | 5/1962 | Ka Dell | 248/223 |
| 3,070,911 | 1/1963 | Slavsky | 40/642 |
| 3,074,194 | 1/1963 | Mapson | 40/650 |
| 3,084,463 | 4/1963 | Guyer | 40/564 |
| 3,094,305 | 6/1963 | Lohrman | 248/222.1 |
| 3,129,751 | 4/1964 | Weber | 248/222.3 |
| 3,148,469 | 9/1964 | Umanoff | 40/651 |
| 3,204,357 | 9/1965 | Marschak | 40/650 |
| 3,220,125 | 11/1965 | Wende | 40/650 |
| 3,228,131 | 1/1966 | Heck | 40/491 |
| 3,337,977 | 8/1967 | Sobesky | 40/650 |
| 3,537,196 | 11/1970 | Hopp | 40/658 |
| 3,955,296 | 5/1976 | Kapstad | 40/658 |
| 4,137,846 | 2/1979 | Rossebo | 101/379 |
| 4,138,019 | 2/1979 | Smith | 211/87 |
| 4,174,580 | 11/1979 | Sanders | 40/518 |
| 4,295,288 | 10/1981 | Westberg | 40/661 |
| 4,301,987 | 11/1981 | Conway | 248/221.4 |
| 4,306,366 | 12/1981 | Taub | 40/649 |
| 4,483,502 | 11/1984 | Fast | 248/222.1 |
| 4,497,464 | 2/1985 | Fast | 248/220.3 |
| 4,562,657 | 1/1986 | Murray | 40/518 |
| 4,603,495 | 8/1986 | Stevens | 40/445 |

*Primary Examiner*—Cary E. Stone

*Attorney, Agent, or Firm*—Foley & Lardner

[57] ABSTRACT

A shelf tag moulding attachment assembly is provided for securing a product information module to a standard shelf tag moulding in a manner as to inhibit unauthorized removal, while permitting easy removal by authorized personnel through use of a grasping device. The assembly preferably includes a mounting member having projections disposed at one end for effecting biting engagement with one of the tag moulding lips, and a lever arm rotatably coupled to the mounting member having a cam at one end disposed to controllably engage the other lip of the tag moulding. The assembly is demountably secured to the tag moulding when the lever arm is rotated with respect to the mounting member.

21 Claims, 6 Drawing Sheets

SHELF TAG MOULDING ATTACHMENT ASSEMBLY

TECHNICAL FIELD

This invention relates, generally, to the attachment of product information to the tag moulding of a shelf upon which merchandise is displayed, and more particularly, to apparatus for removably attaching product information modules to standard shelf tag moulding such as that commonly used in the retail industry.

BACKGROUND OF THE INVENTION

It has long been the common practice of the shelving industry to accommodate retailers by providing them with price tag moulding for shelves used in retail applications. The tag moulding is usually in the form of long, horizontal, extruded aluminum strips affixed to the forward edge of a length of shelving. A typical shelf tag moulding profile includes opposing upper and lower lips, or ridges, into which tags or cards of product information may be inserted. More complex arrangements provide for anchoring an attachment mechanism to the tag moulding from which a separate card or module bearing product, marketing, sale, or promotional information is extended or suspended.

From time to time it is necessary to change the tags because product information, especially price information, is subject to frequent updating. Therefore, a simple procedure for quickly and easily changing the displayed information is desirable. Many attempts have been made to accommodate the need to update product information. Examples of such attempts are described in U.S. Pat. Nos. 3,228,131 issued to Heck on Feb. 25, 1964; and 3,070,911 issued to Slavsky on Jan. 1, 1963. The presently known methods, however, involve extensive labor costs and leave the tags susceptible to tampering.

SUMMARY OF THE INVENTION

The present invention facilitates effective and inexpensive changing of product information within existing shelf tag mouldings. An attachment assembly secures a product information module to standard shelf tag moulding in such a manner as to inhibit unauthorized removal while at the same time permitting easy removal by authorized personnel through use of a grasping device.

A preferred embodiment of the present invention cooperates with an electronic display module including an integral electronic receiver. A transmitter, located in the store offices or stockroom, transmits updated product information directly to the modules. The attachment assembly disposes the module display at an angle conveniently positioned for customer viewing.

BRIEF DESCRIPTION OF THE DRAWINGS

A preferred exemplary embodiment of the present invention will hereinafter be described in conjunction with the appended drawings, wherein like numerals denote like elements, and.

DETAILED DESCRIPTION OF A PREFERRED EXEMPLARY EMBODIMENT

Figure 1A:
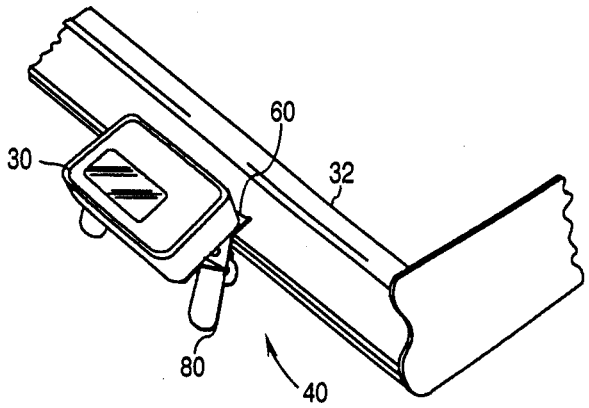
FIG. 1A is a perspective view of an exemplary embodiment of an attachment assembly in accordance with the present invention bearing an information module, shown aligned with the shelf tag moulding to which it will be secured.
Figure 1B:
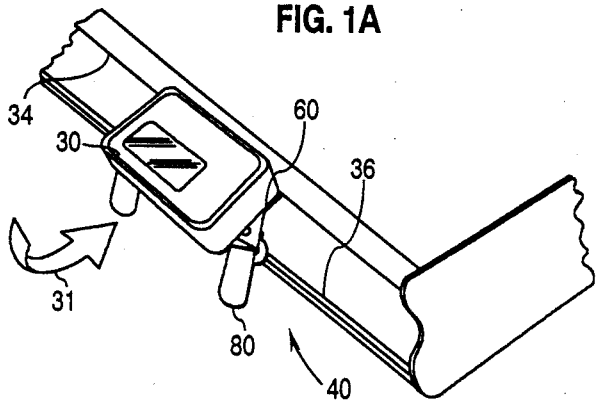
FIG. 1B shows the attachment assembly engaging the upper lip of the shelf tag moulding.
Figure 1C:
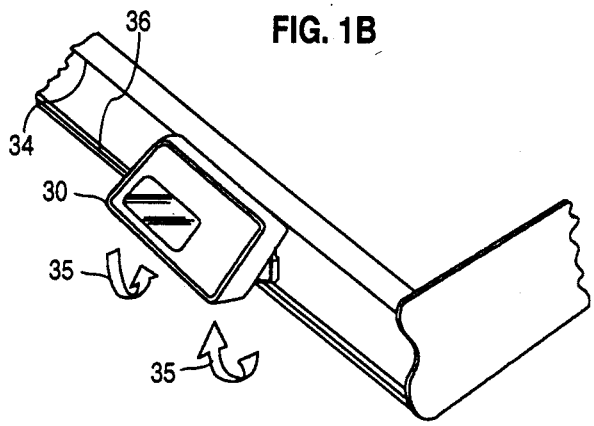
FIG. 1C shows the attachment assembly in its locked position secured to shelf tag molding.
Figure 2:
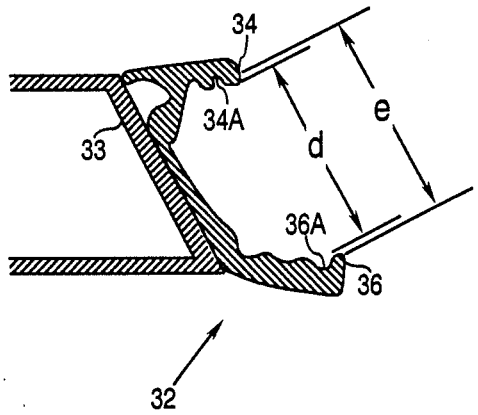
FIGS. 2 and 3 are cross sectional views of two common types of standard tag mouldings attached to a shelf.
Figure 3:
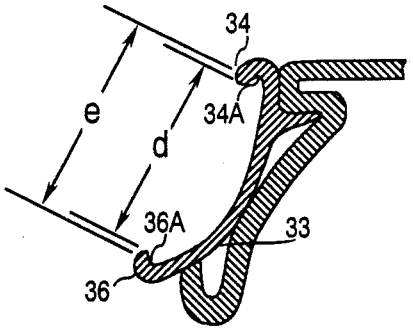
Figure 4:
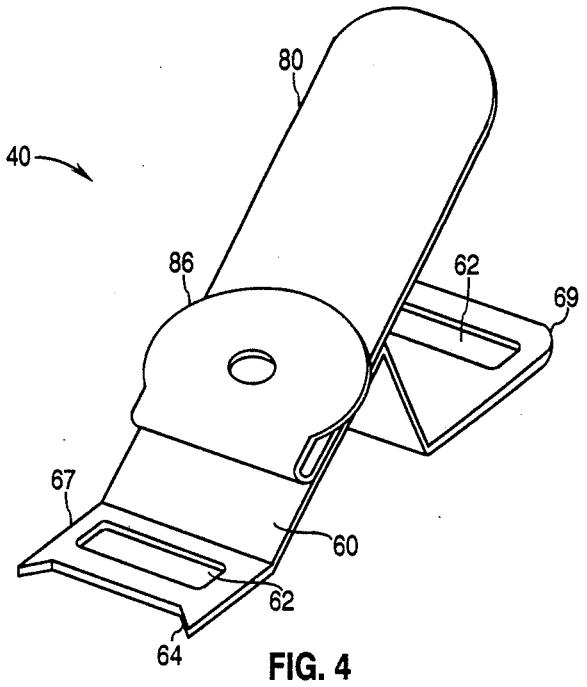
FIG. 4 is a perspective view of an exemplary attachment assembly in accordance with the present invention.
Figure 5:
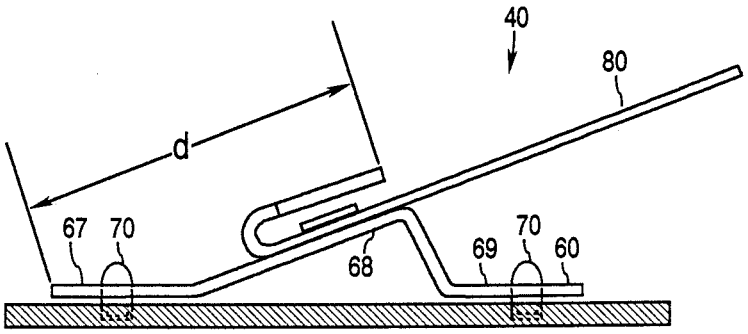
FIG. 5 is a side view of an exemplary attachment assembly in accordance with the present invention.
Figure 6:
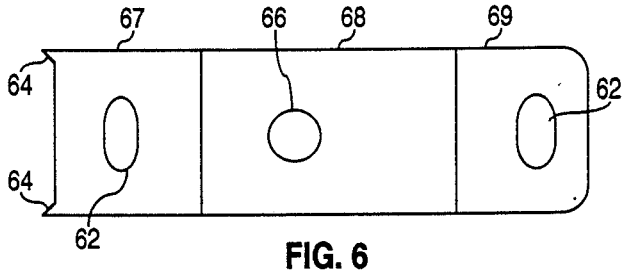
FIG. 6 is an elevation view of the mounting member.
Figure 7:
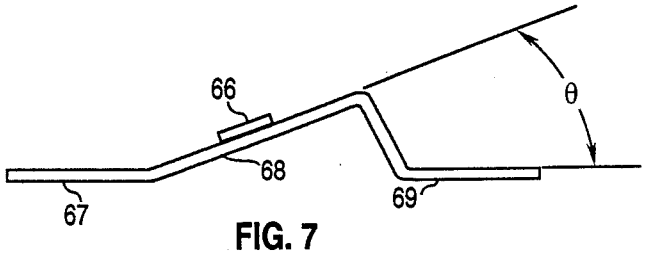
FIG. 7 is a side view of the mounting member.
Figure 8:
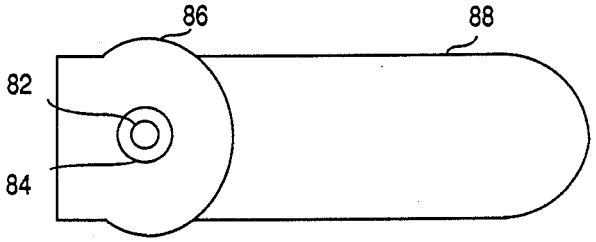
FIG. 8 is an elevation view of the lever arm.
Figure 9:
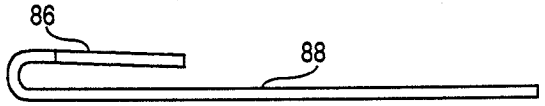
FIG. 9 is a side view of the lever arm.

Referring now to FIGS. 1A–3, an information module 30 is secured to a conventional tag moulding 32 by a predetermined number, preferably two, of attachment assemblies 40 in accordance with the present invention. As best seen in FIGS. 2 and 3, conventional shelf tag moulding 32 suitably comprises, in profile, a back 33, an upper lip 34 and lower lip 36, removed from back 33 by ridges or steps 34A, 36A. Lips 34 and 36 define an opening of predetermined extent d, and ridges 34A, 36A are relatively disposed at a predetermined distance e. Moulding 32 is typically formed of relatively soft extruded aluminium. With specific reference to FIGS. 1A–1C, attachment assembly 40 suitably includes mounting member 60 and a lever arm 80 coupled thereto. One end of lever arm 80 is cam contoured and is suitably bent over to extend, in another plane, back toward the other end of lever arm 80. As will hereinafter be more fully explained, with lever arm 80 (and thus cam 86) in a first position, one end of member 60 and the edge of cam 86 are received between lips 34 and 36 of moulding 32, with the end of member 60 underlying lip 34 (FIG. 1B). Lever arm 80 is then rotated toward the center of module 30 to cause the distance between the end of member 60 and the edge of cam 86 to increase beyond the distance between ridges 34A and 36A. This causes the end of member 60 and the edge of cam 86, respectively, to "bite" into ridges 34A and 36A, securely attaching assembly 40 to tag moulding 32. In the engaged position lever arm 80 is disposed between module 30 and moulding 32, and relatively inaccessible to tampering.

Referring now to FIGS. 4, 5, 6 and 7, mounting member 60 suitably comprises a raised (angled) middle segment 68 disposed between the two end segments 67 and 69. One or more pointed projections 64 may be provided at the end of segment 67 to facilitate biting engagement with moulding 32. Middle segment 68 is suitably disposed at an angle theta ($\theta$) with respect to the plane of either of the two end segments. Angle theta ($\theta$) is chosen to dispose module 30 for ease of viewing when mounted. Angle theta ($\theta$) can range from 0° to 90° for optimum viewing, depending on shelf location. A cylindrical protrusion 66 extends upwardly from raised middle segment 68 to facilitate rotatable mounting of lever arm 80, as will be explained.

Module 30 is affixed to mounting member 60. To this end, slots 62 are suitably provided in end segments 67 and 69 of mounting member 60. Screws 70 disposed through slots 62 fasten module 30 to mounting member 60. Other fastening mechanisms such as, for example, nuts and bolts, rivots, adhesive, swaging, or a clamping arrangement may, of course, be utilized. Module 30 is preferably an alphanumeric display module, such as that described in U.S. Pat. No. 4,603,495 issued on Aug. 5, 1986 to J. Stevens. However, module 30 may be any physical embodiment of information, such as, for example, placards or cards made from paper, cardboard, plastic, or any suitable material.

Referring now to FIGS. 4, 5, 8 and 9, lever arm 80 suitably includes a leg portion 88, a mounting hole 82 and cam portion 86. Cam 86 is suitably bent over, extending, in an overlying plane, toward the distal end of leg 80 with a major axis perpendicular to the axis of leg portion 88 and a minor axis parallel to the axis of leg portion 88. Central opening 84, generally in register with hole 82, is suitably provided in cam 86. Lever arm 80, as well as mounting member 60, can be made from any suitable material sufficiently hard to effect biting engagement with moulding 32, including, but not limited to metal, plastic, or ceramic compositions.

Referring again to FIGS. 4 and 5, lever arm 80 is rotatably coupled, preferably by swaging, to mounting member 60. Lever arm 80 is positioned atop mounting member 60, with cylindrical protrusion 66 received in mounting hole 82. A swage tool is then inserted into central opening 84 and cylindrical protrusion 66 is swaged to retain lever arm 80. In this way, lever arm 80 is permanently coupled to mounting member 60 and is freely rotatable with respect thereto. Other types of rotatable mounting mechanisms may, of course, be used.

Referring again to FIGS. 1A–C, the steps involved in attaching module 30 to shelf tag moulding 32 will be more fully explained. First, pointed projections 64 are inserted under upper lip 34 of tag moulding 32 (FIG. 1A), with lever arm 80 disposed such that the minor axis of cam 86 is in line with the axis of mounting member 60. The entire assembly is then, in effect, pivoted toward moulding 32 (as illustrated by arrow 31) about pointed projections 64 until cam portion 86 passes the rear edge of lower lip 36 as shown in FIG. 1B. To effect biting engagement of both pointed projections 64 and cam portion 86, lever arm 80 is rotated inward (toward the center of module 30, as illustrated by arrows 35) as shown in FIG. 1C. Inward rotation of lever arm 80 causes the major axis edge of cam portion 86 to bite into lower lip 36, and at the same time, forces pointed projections 64 into biting engagement with upper lip 34.

Figure 10:
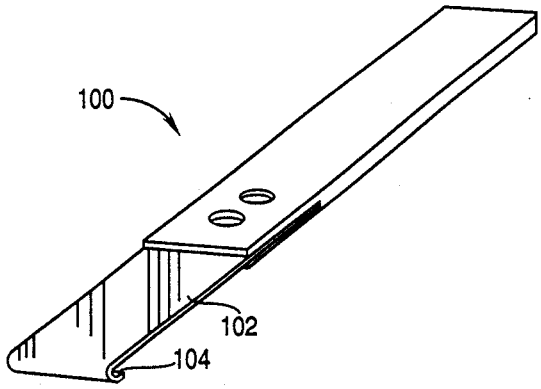
FIG. 10 is a perspective view of the grasping device.

When lever arm 80 is rotated with respect to mounting member 60 to effect biting engagement of the assembly to the shelf tag moulding in the above-described manner, lever arm 80 assumes a position between module 30 and moulding 32. In this position, lever arm 80 is not readily accessible, tending to prevent removal or displacement by unauthorized personnel. A grasping device 100, shown in FIG. 10, is provided for insertion between the attachment assembly and the tag moulding to grasp leg portion 88 and facilitate rotation of lever arm 80, when behind module 30. Grasping device 100 suitably includes a relatively planar arm 102 with a hooked end 104 for grasping lever arm 80.

It will be understood that the above description is a preferred exemplary embodiment of the present invention, and that the invention is not limited to the specific forms shown. Various substitutions, modifications, changes, and omissions may be made in the design and arrangement of the elements without departing from the spirit of the invention as expressed in the appended claims.

I claim:

1. An attachment assembly for cooperating with a shelf tag moulding, said moulding having two parallel oppositely disposed lips, the assembly comprising:
   - a mounting member including means, disposed at one end of said mounting member, for effecting biting engagement with one of said two parallel lips;
   - a lever arm rotatably coupled to said mounting member, having a cam at one end disposed to controllably engage the other of said parallel lips of said tag moulding;
   - said assembly being demountably secured to said tag moulding when said lever arm is rotated with respect to said mounting member.

2. The attachment assembly of claim 1 wherein said lever arm is disposed between said module and said tag moulding when said assembly is demountably secured to said tag moulding such that said lever arm is substantially inaccessible.

3. The attachment assembly of claim 1 wherein said cam is essentially elliptical with the major axis of the ellipse being perpendicular to the longitudinal axis of said lever arm.

4. The attachment assembly of claim 1 wherein said means for effecting biting engagement with one of said two parallel lips comprises at least one pointed projection.

5. An attachment assembly for removably attaching an information module to shelf tag moulding, said moulding having two parallel oppositely disposed lips, the assembly comprising:
   - a mounting member, including means for effecting biting engagement with one of said two parallel lips;
   - a lever arm rotatably coupled to said mounting member, having a cam contour at one end for controllably engaging the other of said parallel lips of said tag moulding; and
   - grasping means for releasably grasping said lever arm to rotate said lever arm with respect to said mounting member to effect disengagement of said attachment assembly from said tag moulding.

6. The attachment assembly of claim 5 wherein said grasping means comprises a handle and a grasping end, said grasping end being looped around to form a C-shaped hook for releasably engaging said lever arm.

7. The attachment assembly of claim 5 wherein said biting means for engaging one of said two parallel lips comprises at least one pointed projection.

8. A module assembly for disposition on a shelf tag moulding, said moulding having two parallel oppositely disposed lips, the assembly comprising:
   - an information display module;
   - a mounting member, including means for effecting a biting engagement with one of said two parallel lips;
   - a means for affixing said module to one side of said mounting member; and
   - a lever arm rotatably coupled to said mounting member, said lever arm having a cam contour at one end for controllably engaging the other of said parallel lips of said tag moulding.

9. An attachment assembly for attaching an information module to shelf tag moulding, said moulding having parallel oppositely disposed lips, the assembly comprising:
   - a mounting member adapted to be affixed to said module;

said mounting member including first and second end segments and a raised middle segment;

said first end segment including at least one projection for effecting biting engagement with one of said lips of said moulding;

a lever arm including a leg portion and an overlying cam portion disposed at one end of said leg portion;

a means for pivotally mounting said lever arm onto said raised middle segment in the vicinity of said cam portion;

said cam portion being disposed relative to said first end of said mounting member, to effect biting engagement with said moulding when said lever arm is disposed in a first predetermined position, disengaging said moulding when said lever arm is disposed in a second predetermined position.

10. The attachment assembly of claim 9 wherein said lever arm is disposed between said module and said tag moulding when said lever arm is disposed in said first predetermined position.

11. An attachment assembly for cooperating with a shelf tag moulding, said moulding having two parallel oppositely disposed lips, the assembly comprising:

a mounting member, having a means disposed at one end for effecting biting engagement with one of said parallel lips; and a lever arm, rotatably coupled to said mounting member, comprising a leg portion and a second portion including a cam, said cam disposed at one end of said second portion to controllably engage the other of said parallel lips of said tag moulding, said second portion being looped around to form a U-shape such that said second portion is substantially parallel to said leg portion;

said assembly being demountably secured to said tag moulding when said lever arm is rotated with respect to said mounting member.

12. The attachment assembly of claim 11 wherein said cam contour is essentially elliptical with the major axis of the ellipse being perpendicular to the longitudinal axis of said leg portion.

13. The attachment assembly of claim 11 wherein said second portion of said lever arm includes a center opening;

said leg portion of said lever arm includes a hole;

said hole being concentric with and in a plane substantially parallel to the plane of said center opening.

14. The attachment assembly of claim 11 wherein said lever arm comprises a fabricated strip of metal.

15. The attachment assembly of claim 11 wherein the outer edge of said cam contour is between 0.010 and 0.036 inch thick.

16. An attachment assembly for cooperating with a shelf tag moulding, said moulding having two parallel oppositely disposed lips, the assembly comprising:

a mounting member including substantially rectilinear coplaner first and second end segments and a raised middle segment disposed therebetween, one of said end segments including means for effecting biting engagement with one of said parallel lips;

a lever arm rotatably coupled to said mounting member having a cam at one end disposed to controllably engage the other of said parallel lips of said tag moulding; and said assembly being demountably secured to said tag moulding when said lever arm is rotated with respect to said mounting member.

17. The attachment assembly of claim 16 wherein said raised middle segment of said mounting member has an upwardly extending cylindrical protrusion, said protrusion being received in a hole in said lever arm.

18. The attachment assembly of claim 16 wherein said mounting member comprises a fabricated strip of metal.

19. The attachment assembly of claim 16 wherein said end segments of said mounting member have at least one slot.

20. An attachment assembly for cooperating with a shelf tag moulding, said moulding having two parallel oppositely disposed lips, the assembly comprising:

a mounting member including first and second end segments and a raised middle segment disposed therebetween, said middle segment having a portion transverse to the plane in which one of said end segments lie, one of said end segments including means for effecting biting engagement with one of said parallel lips;

a lever arm rotatably coupled to said mounting member, having a cam at one end disposed to controllably engage the other of said parallel lips of said tag moulding; and said assembly being demountably secured to said tag moulding when said lever arm is rotated with respect to said mounting member.

21. A module assembly, for disposition on a shelf tag moulding having two parallel oppositely disposed lips, the assembly being of the type comprising an information display module, a mounting member, and means for demountably affixing said mounting member to said tag moulding, improved wherein:

said means for affixing said mounting member to said tag moulding comprises:

biting means for effecting biting engagement with one of said parallel lips; and cam means for controllably engaging the other of said parallel lips, the operation of said cam means causing said biting means to effect said biting engagement and causing said cam means to effect said controllable engagement.

* * * * *